United States Patent [19]

Retallack

[11] 4,251,338

[45] Feb, 17, 1981

[54] ELECTROLYTIC RECOVERY OF LITHIUM FROM BRINES

[75] Inventor: Robert L. Retallack, Corpus Christi, Tex.

[73] Assignee: PPG Industries, Inc., Pittsburgh, Pa.

[21] Appl. No.: 73,353

[22] Filed: Sep. 7, 1979

[51] Int. Cl.[3] ..... C25B 1/16; C25C 3/02

[52] U.S. Cl. ..... 204/130; 204/149; 204/152; 423/179.5; 423/184

[58] Field of Search ..... 204/149, 152, 130; 423/179.5, 184

[56] References Cited

U.S. PATENT DOCUMENTS

| | | | |
|---|---|---|---|
| 836,781 | 11/1906 | Poulenc | 423/179.5 |
| 1,964,161 | 6/1934 | Kuhnert | 23/38 |
| 2,964,381 | 12/1960 | Goodenough | 423/179.5 |
| 2,977,185 | 3/1961 | Goodenough | 423/179.5 |
| 2,980,497 | 4/1961 | Goodenough et al. | 423/179.5 |
| 3,007,771 | 11/1961 | Mazza et al. | 23/63 |
| 3,112,172 | 11/1963 | Archambault et al. | 23/63 |
| 3,306,700 | 2/1967 | Neipert et al. | 423/179.5 |
| 3,506,393 | 4/1970 | Bon et al. | 23/52 |
| 3,597,340 | 8/1971 | Honeycutt et al. | 204/98 |
| 3,715,290 | 2/1973 | Yokozeki et al. | 204/96 |
| 3,857,920 | 12/1974 | Grantham et al. | 423/208 |
| 4,036,713 | 7/1977 | Brown | 204/98 |
| 4,149,953 | 4/1979 | Rojo | 204/152 X |
| 4,152,229 | 5/1979 | Soltys et al. | 204/152 X |
| 4,159,246 | 6/1979 | Matsumoto | 204/149 X |

*Primary Examiner*—Arthur C. Prescott
*Attorney, Agent, or Firm*—Richard M. Goldman

[57] ABSTRACT

Disclosed is a method of recovering lithium ion from a lithium-containing solution by electrolyzing the solution between a cathode and an aluminum anode.

8 Claims, No Drawings

ELECTROLYTIC RECOVERY OF LITHIUM FROM BRINES

DESCRIPTION OF THE INVENTION

Lithium may be obtained by recovery of lithium from brines containing lithium salts. Suitable brines include sodium chloride brines, i.e., brines containing from about 80 to 120 grams per liter of sodium ion, from about 0.5 to about 10 grams per liter of magnesium ion, from about 10 to about 50 grams per liter of calcium ion, from about 100 to about 1,000 milligrams per liter of lithium ion, from about 150 to about 200 grams per liter of chlorine, up to about 10 grams per liter of bromide ion, and up to about 1 gram per liter of iodide ion. Alternatively, lithium may be recovered, although in lesser amounts, from potassium chloride brines, from mixed potassium chloride-sodium chloride brines, from mixed potassium chloride-sodium chloride-magnesium chloride brines and from mixed potassium chloride-magnesium chloride brines. Generally, these brines contain from about 100 to about 1,000 milligrams per liter of lithium ion.

In the past, lithium ion has been recovered from the brine by aluminate precipitation as $LiAlO_x$ where x is from about 2 to about 4. However, the high cost of the aluminum relative to the value of the lithium recovered makes it advisable to have either recovery of the aluminum, or a low cost source of the aluminum, or both recovery of the aluminum and a low cost source of the aluminum.

It has now been found that $LiAlO_x$ can be precipitated from lithium brine by electrolyzing the lithium-containing brine with an aluminum anode. It has further been found that the aluminum introduced from the aluminum anode may be a source of aluminum in a lithium precipitation process where aluminum is subsequently recycled with some of the aluminum lost. Such a process would include a sodium aluminate precipitation process where lithium is precipitated by sodium aluminate, and aluminum is introduced into the process by electrolysis to make up for the aluminum lost in the various steps of the recycling process. Additionally, the process herein contemplated utilizes scrap aluminum as the aluminum anode.

DETAILED DESCRIPTION OF THE INVENTION

The method of recovering lithium from aqueous solutions described herein is useful with the brines described above. Such brines typically contain from about 100 to about 1,000 parts per million lithium, although the process herein contemplated is feasible with solutions having higher or lower lithium ion concentrations.

The method herein contemplated calls for the formation of an insoluble lithium aluminum oxycompound within the solution and recovery of the insoluble compound from the solution. By an insoluble lithium aluminum compound is meant those compounds having the general formula $LiAlO_x$ where x is from about 2 to about 4, although more complex compositions of lithium, aluminum, oxygen, other alkali metals, e.g., sodium, and potassium, and alkaline earth metals may also be precipitated. It is to be understood that the precipitate or filter cake will also contain significant amounts of entrained brine which may include sodium ion, potassium ion, magnesium ion, calcium ion, chloride ion, iodide ion, and bromide ion.

The improvement contemplated herein comprises electrolyzing the lithium containing solution, that is, the lithium containing brine, between an electrode pair having a cathode and an aluminum anode, by which process there is formed an insoluble lithium-aluminum oxy compound as described above.

In the electrode pair utilized in the method of this invention, the cathode may be any material that is insoluble in the solution, for example, titanium, iron, steel, mild steel, stainless steel, carbon, or various other transition metals. Alternatively, the cathode may be aluminum, especially in a process where there is polarity reversal.

The anode is an aluminum anode. The anode may be metallurgical grade aluminum, standard commercial aluminum, chemically pure aluminum or the like. However, in a particularly desirable exemplification of this invention, the aluminum is scrap aluminum, for example, beverage cans, remnants of architectural products, metal scrap, and the like. The aluminum anode may be porous, impervious, plates, sheets, foils, particles, powder or the like. Generally, about 11 to 12 pounds of aluminum is solubilized per pound of lithium recovered.

The insoluble lithium aluminum oxycompound $LiAlO_x$, where x is from about 2 to about 4, is a precipitate which can entrain brine therein. It may be separated from the solution by filtration, centrifugation, skimming, settling, or other physical means of separation. The solid filter cake generally contains about 1.0 to 3.0 weight percent lithium, dry basis.

Where the brine contains magnesium, especially in amounts high enough to interfere with the electrochemical process, that is in an amount above about 1 gram per liter, and generally in an amount above about 10 grams per liter, the brine may be treated with a precipitant such as calcium hydroxide, to both render the brine strongly alkaline and to precipitate magnesium.

In the method of this invention, electrolysis is carried out with constant polarity, that is with one electrode always the anode and the opposite electrode always the cathode. Alternatively, the cell may be operated with reversible polarity e.g., with periodic reversal or even with alternating current. This is especially advantageous where both electrodes are aluminum, whereby to provide cleaner electrodes and more widely dispersed sources of aluminum for the electrolyte.

The pH of the brine is maintained above 5, for example, about 5 to about 7, or even alkaline. This may be accomplished by starting the process with strongly alkaline brine, as where calcium hydroxide has been added to the brine to precipitate magnesium ion, or where there has been initial treatment of the brine with sodium hydroxide or potassium hydroxide. Alternatively, suitable alkali metal hydroxide for example, sodium hydroxide or potassium hydroxide, may be added to the brine during electrolysis. The addition may be at a constant rate, or responsive to changes in the pH.

The electrolysis may be carried out at a high current density, for example, above about 100 amps per square foot, preferably above 200 to about 500 amps per square foot, or even above about 500 amps per square foot. Alternatively, the method of this invention may be carried out at a lower current density, for example, below about 50 amperes per square foot or even below about 20 amperes per square foot, especially where the brine is relatively dilute in lithium and substantially stoichiometric removal of the lithium is desired.

The voltage is from about 2 to about 5 volts at the current densities herein contemplated.

The method of this invention may be carried out batchwise, with the lithium-containing brine fed to an electrolytic cell and maintained in the electrolytic cell during electrolysis and formation of the precipitate. Alternatively, the method of this invention may be carried out as a continuous process with the feed of lithium containing brine to an electrolytic cell and the constant or semi-constant recovery of brine depleted in lithium content and of precipitate from the cell.

The method of this invention may be advantageously carried out in treating a brine containing approximately 500 milligrams per liter of lithium ion, approximately 120 grams per liter of sodium ion, approximately 30 grams per liter of calcium ion, approximately 2 grams per liter of magnesium ion, approximately 190 grams per liter of chloride ion, approximately 2 grams per liter of bromide ion and approximately 100 parts per million of iodide ion, by first treating the brine with calcium hydroxide whereby to precipitate the magnesium hydroxide. Thereafter the brine, at a strongly alkaline pH, i.e., above about 12, is filtered to remove the magnesium solids, and fed to an electrolytic cell. The electrolytic cell may have a pair of scrap aluminum electrodes, for example, aluminum beverage cans, or aluminum shreds in open mesh fluorocarbon bags having current leads thereto. Electrolysis is commenced at a pH of about 12 and a voltage of about 2 to 4 volts whereby to provide a current density of between 100 and 200 amperes per square foot. After a sufficient period of electrolysis to solubilize approximately 12 pounds of aluminum per pound of lithium in the solution, the electrolysis is stopped and precipitate removed from the cell, for example, by filtration. Thereafter the solid is again filtered, for example, to remove sodium chloride, and the remaining solid obtained therefrom, containing approximately 3 weight percent lithium, is roasted whereby to obtain lithium oxide and aluminum oxide.

The following examples are illustrative of the method of this invention.

EXAMPLE I

A lithium containing brine was electrolyzed between a steel cathode and an aluminum anode, and an insoluble lithium-aluminum product was formed.

Four hundred milliliters of a brine containing 507 milligrams per liter of lithium ion, 1.8 grams per liter of magnesium ion, 32.6 grams per liter of calcium ion, approximately 120 grams per liter of sodium ion, 3.3 grams per liter of bromide ion, and approximately 192 grams per liter of chloride ion, was placed in a glass beaker. The solution was then heated to 75° C. Electrolysis was commenced in the beaker, with a steel cathode and an aluminum anode, and an insoluble precipitate was seen to form.

EXAMPLE II

A lithium-containing brine was electrolyzed between a pair of aluminum sheet coupon electrodes.

Four hundred milliliters of the brine described in Example I was placed in a glass beaker and heated to 75° C. and electrolysis was commenced at a current density of approximately 58 amperes per square foot. Electrolysis was carried out with the pH maintained between 5.25 and 7.0 by the periodic addition of ten percent aqueous NaOH, and with periodic current reversal.

After 1 hour of electrolysis there was 78.3 percent recovery of lithium at 19 percent current efficiency.

EXAMPLE III

A lithium containing brine was electrolyzed between a pair of aluminum sheet coupon electrodes.

One liter of the brine described in Example I was placed in a glass beaker and heated to 75° C. Electrolysis was commenced at a current density of 144 amperes per square foot, an initial cell voltage of 1.8 volts, and an initial brine pH of 6.1.

Cell polarity was reversed after 12.5, 30, and 45 minutes of electrolysis. The electrolyte pH was maintained above 5.2 by the dropwise addition of 28 milliliters of 10 weight percent sodium hydroxide.

After one hour of electrolysis 0.274 gram of lithium was recovered as $LiAlO_x$ at a current efficienty of 22 percent, and 9.41 grams of aluminum electrode solubilized per gram of lithium recovered.

EXAMPLE IV

A dilute lithium containing brine was electrolyzed between a pair of aluminum sheet coupon electrodes.

Five hundred milliliters of the brine described in Example I was mixed with five hundred milliliters of distilled water to provide a brine containing 254 milligrams per liter of lithium. The brine was placed in a 1500 milliliter beaker, and heated to 70° C.

The initial brine pH was 6.2. Electrolysis was commenced at a current density of 38 amperes per square foot, an initial pH of 6.2, and an initial voltage of 1.7 volts. Polarity was reversed after every thirty minutes of electrolysis, and electrolyte pH was maintained at 5.6 by the dropwise addition of 10.5 milliliters of 10 weight percent sodium hydroxide over the two and one half hours of electrolysis.

After two and one half hours of electrolysis 0.241 gram of lithium was recovered at a current efficiency of 19 percent, and an aluminum efficiency of 14.3 grams of aluminum electrode solubilized per gram of lithium recovered.

EXAMPLE V

A dilute lithium containing brine was electrolyzed between a pair of scrap aluminum electrodes.

Two aluminum carbonated beverage cans were utilized as electrodes. The tops and bottoms of the cans were cut off, and the cans were then folded four times to make coupon-type aluminum electrodes.

Eight hundred milliliters of the brine described in Example I was mixed with four hundred milliliters of distilled water to provide a brine containing 338 milligrams per liter of lithium. The brine was placed in a 1500 milliliter beaker between the pair of scrap aluminum electrodes and electrolysis was carried out for three hours at a current of 2 amperes, an initial pH of 6.1, and an initial voltage of 2.8 volts. The pH was maintained above 5.1 by the periodic dropwise addition of 22.5 milliliters of 10 weight percent sodium hydroxide over the course of the electrolysis. The polarity was reversed every half hour.

After 3 hours of electrolysis 0.377 gram of lithium was recovered at a current efficiency of 24 percent.

EXAMPLE VI

A lithium-containing brine was electrolyzed between a pair of aluminum sheet coupon electrodes at a current density of 165 amperes per square foot.

One liter of the brine described in Example I was mixed with one hundred milliliters of distilled water to provide a brine containing 460 milligrams per liter of lithium. The brine was placed in a 1500 milliliter beaker between a pair of 1.5 inch by 5 inch aluminum coupons.

Electrolysis was commenced at a brine pH of 5, a cell voltage of 2.6 volts, and a current of 8.5 amperes. The pH was maintained between 5 and 6 by the addition of 36 milliliters of 10 weight percent sodium hydroxide over the two hours of electrolysis.

After two hours of electrolysis 0.506 gram of lithium was recovered for substantially one hundred percent lithium recovery, at a current efficiency of 11.5 percent, and 23.7 grams of aluminum electrode solubilized per gram of lithium recovered.

EXAMPLE VII

A lithium-containing brine was treated with aqueous calcium hydroxide, and thereafter electrolyzed between a pair of aluminum sheet coupon electrodes.

Five hundred milliliters of the brine described in Example I was mixed with one hundred milliliters of distilled water to provide a lithium content of 423 milligrams per liter. Two hundred milliliters of calcium hydroxide was added to the brine and the precipitate filtered off.

The filtrate had a pH of 12. The filtrate was heated to 75° C. and electrolyzed at a current density of 165 amperes per square foot. Electrolysis was carried out until the pH dropped to 6, i.e., about 35 minutes.

After 35 minutes of electrolysis 0.241 gram of lithium had been recovered at a current efficiency of 12 percent, and 9.75 grams of aluminum electrode solubilized per gram of lithium recovered.

While the invention has been described with respect to certain preferred exemplifications and embodiments thereof, the scope and content of the invention is not to be so limited thereby but is as defined in the claims appended hereto.

I claim:

1. In a method of recovering lithium from an aqueous solution, comprising forming insoluble lithium-aluminum oxycompounds, and separating the insoluble lithium-aluminum oxycompounds from the solution, the improvement comprising electrolyzing the lithium containing aqueous solution between an electrode pair having a cathode and an aluminum anode whereby to form insoluble lithium-aluminum oxycompounds.

2. The method of claim 1 wherein the initial lithium content of the aqueous solution is from about 100 to about 1000 parts per million.

3. The method of claim 1 wherein the aqueous solution initially contains magnesium, and wherein said solution is treated with an alkali metal hydroxide to precipitate the magnesium prior to electrolysis.

4. The method of claim 1 comprising recovering aluminum from the lithium-aluminum oxycompound precipitate.

5. The method of claim 1 wherein both members of the electrode pair are aluminum.

6. The method of claim 5 comprising periodically reversing polarity.

7. The method of claim 1 wherein the aluminum anode is scrap aluminum.

8. In a method of recovering lithium from an aqueous solution, comprising forming insoluble lithium-aluminum oxycompounds, and separating the insoluble lithium-aluminum oxycompound from the solution, the improvement comprising electrolyzing the lithium containing aqueous solution between an aluminum anode and an aluminum cathode, and periodically reversing the polarity therebetween, thereby forming insoluble lithium-aluminum compounds.

* * * * *